US011548602B1

(12) United States Patent
Rienerth et al.

(10) Patent No.: US 11,548,602 B1
(45) Date of Patent: Jan. 10, 2023

(54) PORTABLE PROPULSION FACILITATION SYSTEM, DEVICE AND METHOD

(71) Applicants: Randall Vann Rienerth, Kill Devil Hills, NC (US); Jay Robert Scanny, Jensen Beach, FL (US)

(72) Inventors: Randall Vann Rienerth, Kill Devil Hills, NC (US); Jay Robert Scanny, Jensen Beach, FL (US)

( * ) Notice: Subject to any disclaimer, the term of this patent is extended or adjusted under 35 U.S.C. 154(b) by 0 days.

(21) Appl. No.: 17/838,367

(22) Filed: Jun. 13, 2022

(51) Int. Cl.
*B63H 20/02* (2006.01)

(52) U.S. Cl.
CPC ..... *B63H 20/02* (2013.01)

(58) Field of Classification Search
CPC ..... B63H 20/02; B63H 20/06; B63H 21/17
See application file for complete search history.

(56) References Cited

U.S. PATENT DOCUMENTS

| | | | | |
|---|---|---|---|---|
| 1,021,408 | A | 3/1912 | Haschke | |
| 2,676,559 | A * | 4/1954 | Davies | B63H 23/04 123/195 P |
| 3,604,674 | A * | 9/1971 | Wilkerson | B63H 20/06 248/642 |
| 4,678,440 | A * | 7/1987 | Rodrigue | B63H 20/08 114/355 |
| 5,499,792 | A | 3/1996 | Tamiso | |
| 6,053,471 | A | 4/2000 | Brown | |
| 6,227,514 | B1 | 5/2001 | Williams | |
| 7,201,621 | B2 | 4/2007 | Jones | |
| 7,399,211 | B1 | 4/2008 | Spaulding | |
| 8,747,171 | B2 | 6/2014 | Grez | |
| 8,790,145 | B2 | 7/2014 | Reid et al. | |
| 10,011,329 | B1 * | 7/2018 | Cooper | B63B 32/10 |
| 2014/0364020 | A1 * | 12/2014 | Stone | B63H 20/02 440/6 |
| 2021/0354541 | A1 | 11/2021 | Zeiler et al. | |
| 2022/0219798 | A1 * | 7/2022 | Achard | B63H 20/00 |

* cited by examiner

*Primary Examiner* — Stephen P Avila
(74) *Attorney, Agent, or Firm* — Williams Mullen; Thomas F. Bergert

(57) ABSTRACT

Embodiments of a portable propulsion facilitation device and system for a marine vessel provide a rechargeable power source and a removable trolling motor mounting base securable to a marine vessel. In various embodiments, the power source employs rechargeable batteries that are secured within a cover. The device can include an access door that permits a user to access the power source when removal or replacement is necessary. The power source can be maintained within a housing of a trolling motor or one or more housings secured to the mounting base. In various embodiments, the mounting base is integrated with, or attachable to, one or more tubes, wherein the tube(s) can be secured and/or placed in a traditional fishing rod holder or other opening on the vessel. A trolling motor can be secured to the mounting base.

19 Claims, 6 Drawing Sheets

PORTABLE PROPULSION FACILITATION SYSTEM, DEVICE AND METHOD

TECHNICAL FIELD

The present disclosure pertains to power generation, and more particularly to a portable system, device and method for facilitating propulsion for a water vessel.

BACKGROUND AND SUMMARY

Trolling motors are often employed on marine vessels as a simple and relatively quiet way to manipulate a vessel slowly when fishing and/or when in shallower waters. Currently, trolling motors share a traditional solution for delivering power to the trolling motor. Power is delivered from a traditional marine battery by running wires from the battery (s) that are permanently mounted in the vessel to a connection from the trolling motor mount that is essentially permanently mounted to the bow deck area.

Removal of a trolling motor is desirable on occasion for many reasons. For example, a boat operator may desire to remove a trolling motor for security purposes and/or when a trolling motor is not needed. In recent times, larger trolling motors have been employed on larger marine vessels where trolling motors have not traditionally been employed, as these trolling motors can be controlled or controllable by geo-positioning systems (GPS) when the larger vessels are fishing offshore, for example, and operators do not wish to employ traditional engines or an anchor for that purpose. It is therefore becoming of increasing importance and desirability to be able to remove trolling motors when not in use.

While it is possible to remove a mounting bracket supporting a traditional trolling motor, such removal can require multiple tools and is awkward and time consuming. As a separate problem, it is possible for the battery or batteries of the trolling motor to lose charge, particularly if the vessel is dormant over a certain period. Re-charging the battery or batteries often requires removing the battery or batteries from the vessel.

The present disclosure provides a power source that employs rechargeable batteries making the trolling motor and power source an integrated system. The power source can be secured within a cover for a trolling motor compartment and/or within one or more covers or boxes on a trolling motor mounting base, with an access door that permits a user to access the power source when removal or replacement is necessary. The battery or batteries can be provided in different voltages based on the power need of the trolling motor. In various embodiments, the cover houses a power pack docking station for the removable battery or batteries. Recharging can be accomplished using a 110V AC to 12V charging unit or similar unit, for example. In various embodiments, an onboard charging station is provided to permit charging the propulsion power source on the vessel itself.

In various embodiments, the presently disclosed device and system further provide a removable flat trolling motor mounting base integrated with, or attachable to, one or more tubes, wherein the tube(s) can be secured and/or placed in a traditional fishing rod holder or other opening on the vessel. In various embodiments, the mount includes one main tube in a standard size to fit a traditional rod holder with a substantially flat platform or surface onto which a trolling motor can be mounted. One or more stabilizing bolts can be provided on the flat surface and can attach to the vessel's bow deck or gunwale via a threaded head stainless steel button bolt receiver or other receiver. The bolt receiver may be permanently mounted on the bow deck and the stabilizing bolt(s) can be inserted into the threaded bow deck button bolt receiver to secure and stabilize the mount.

In various embodiments where a rod holder or similar opening is not available on the vessel, the mount can be secured to the vessel in other ways such as through stabilizing bolts and threaded receivers such as button receivers as described herein. Using the device and system as described herein permits the safe and easy removal of the trolling motor and portable bracket without the use of tools, while further providing readily available power to the trolling motor without the need for removing any batteries.

DETAILED DESCRIPTION OF EMBODIMENTS

Figure 1:
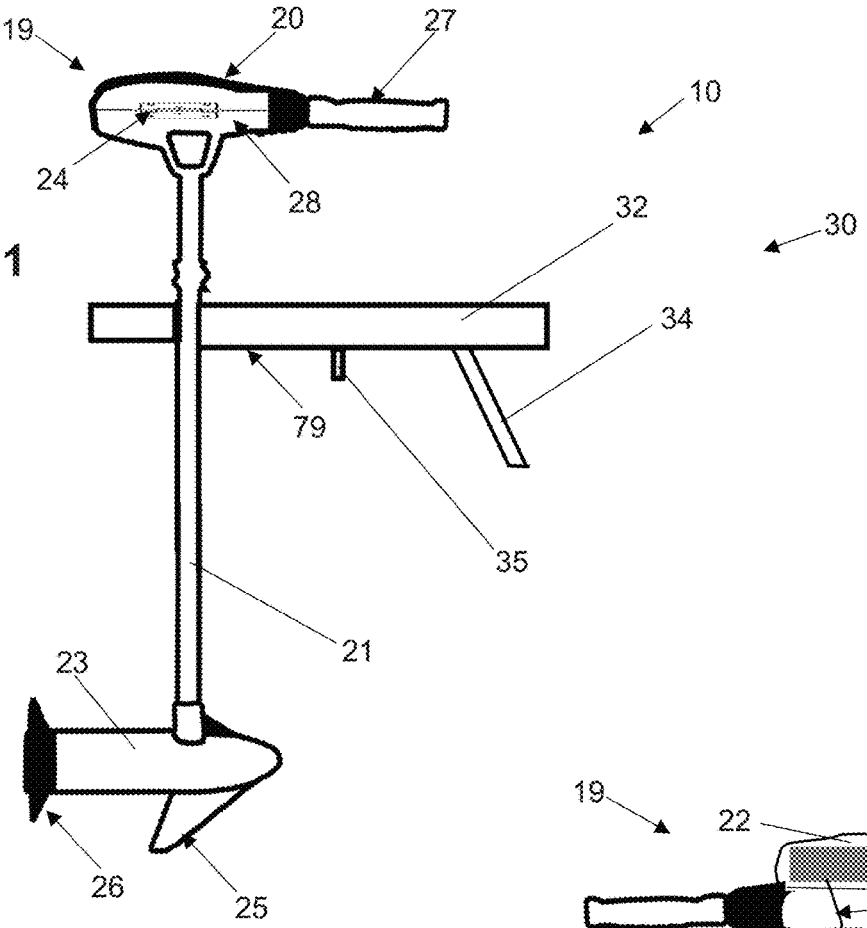
FIG. 1 is a left side schematic view of a trolling motor with elements in accordance with embodiments of the present disclosure.
Figure 2:
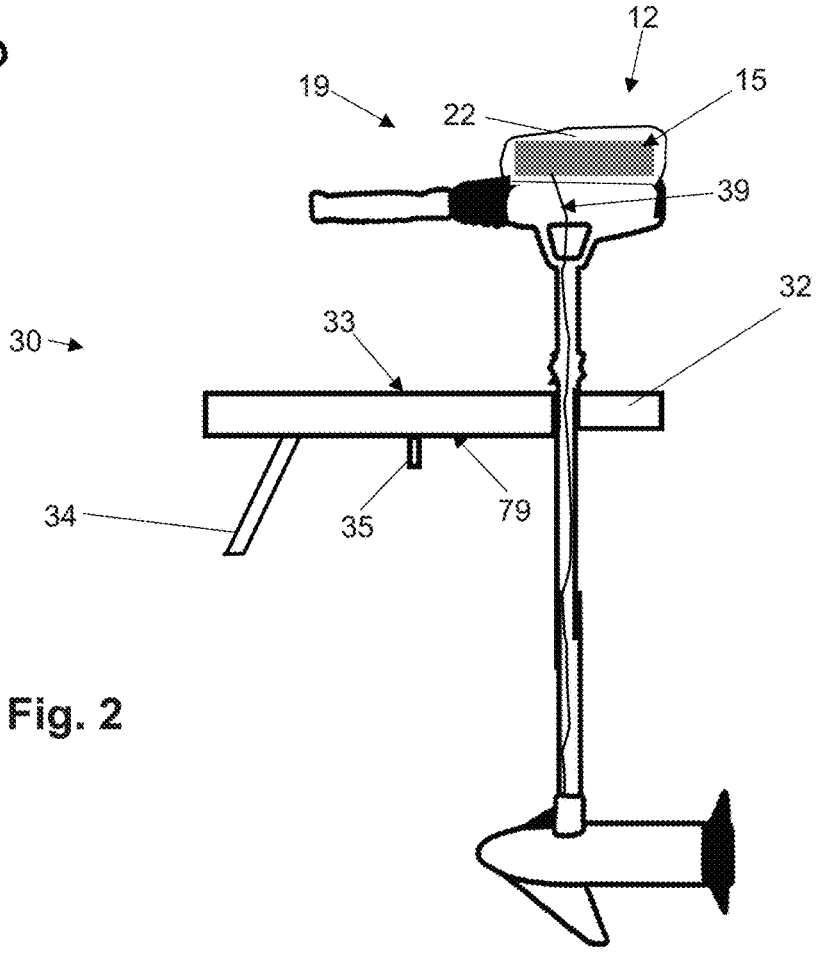
FIG. 2 is a right side schematic view of the trolling motor of FIG. 1, with elements in accordance with embodiments of the present disclosure.
Figure 3:
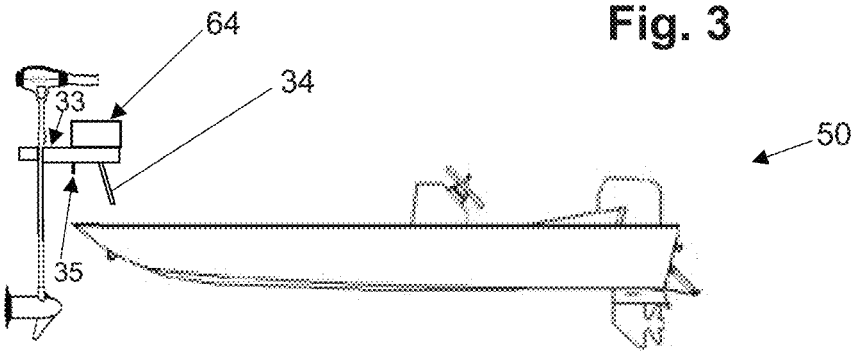
FIG. 3 is a side view of a water vessel with elements in accordance with embodiments of the present disclosure, prior to the installation of such elements.
Figure 4:
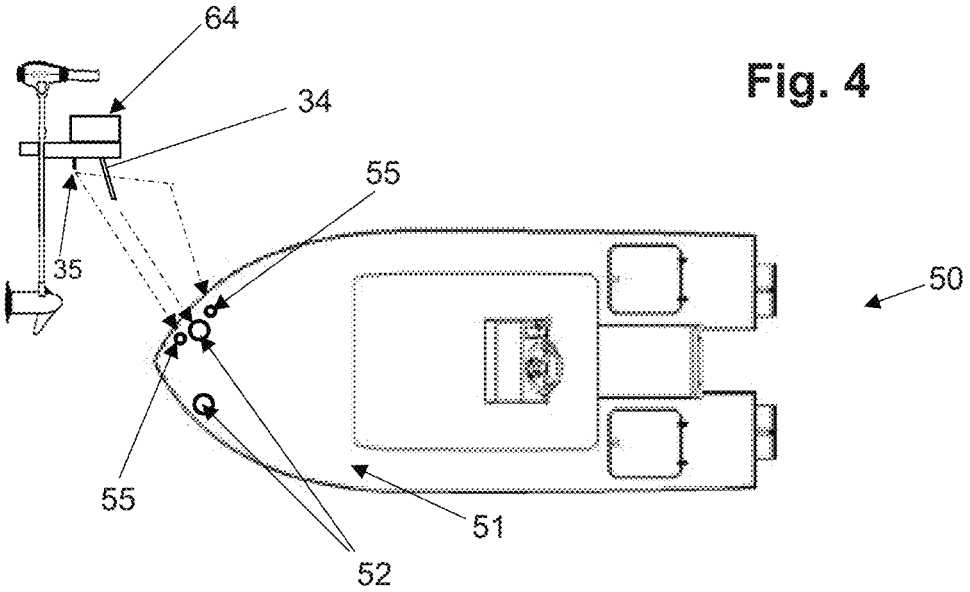
FIG. 4 is a top view of a water vessel with elements of the present disclosure prior to installation of the elements.
Figure 5:
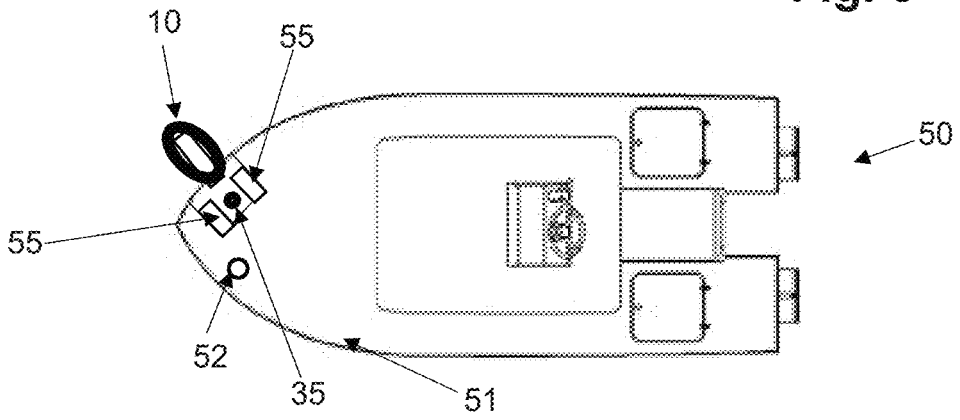
FIG. 5 is a top view of a water vessel after installation of elements of the present disclosure.
Figure 6:
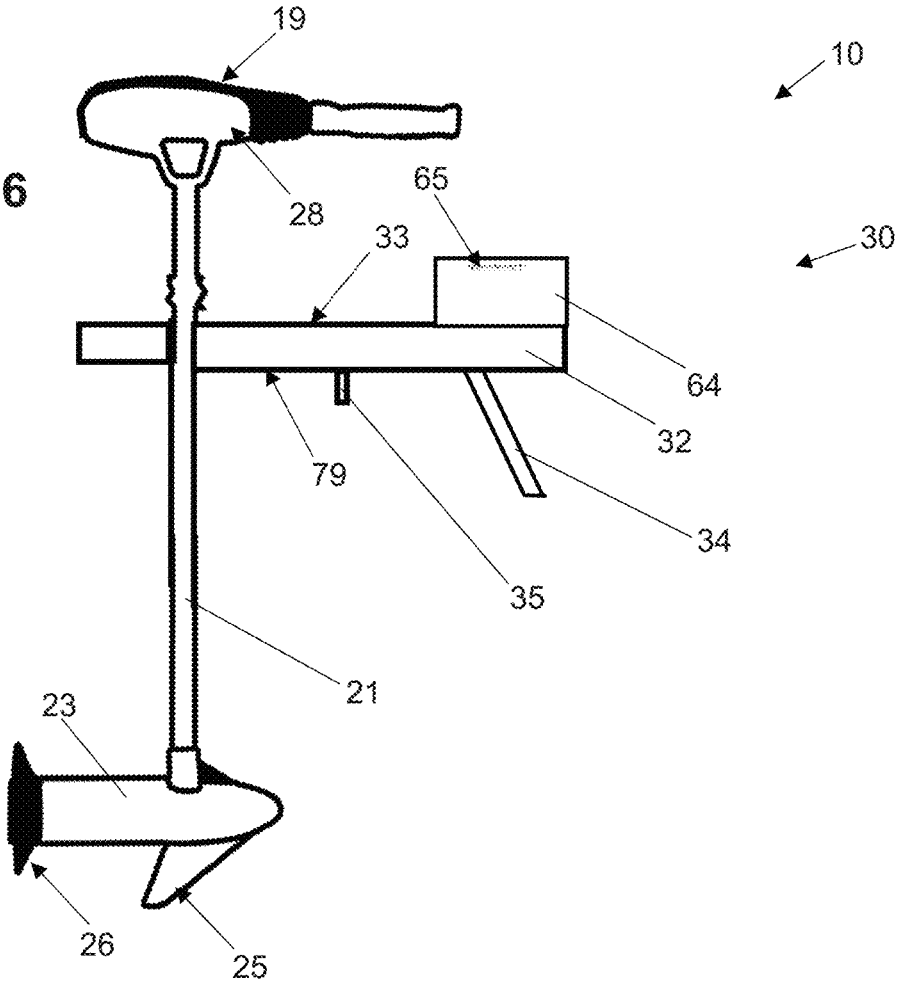
FIG. 6 is a left side schematic view of a trolling motor with elements in accordance with embodiments of the present disclosure.
Figure 7:
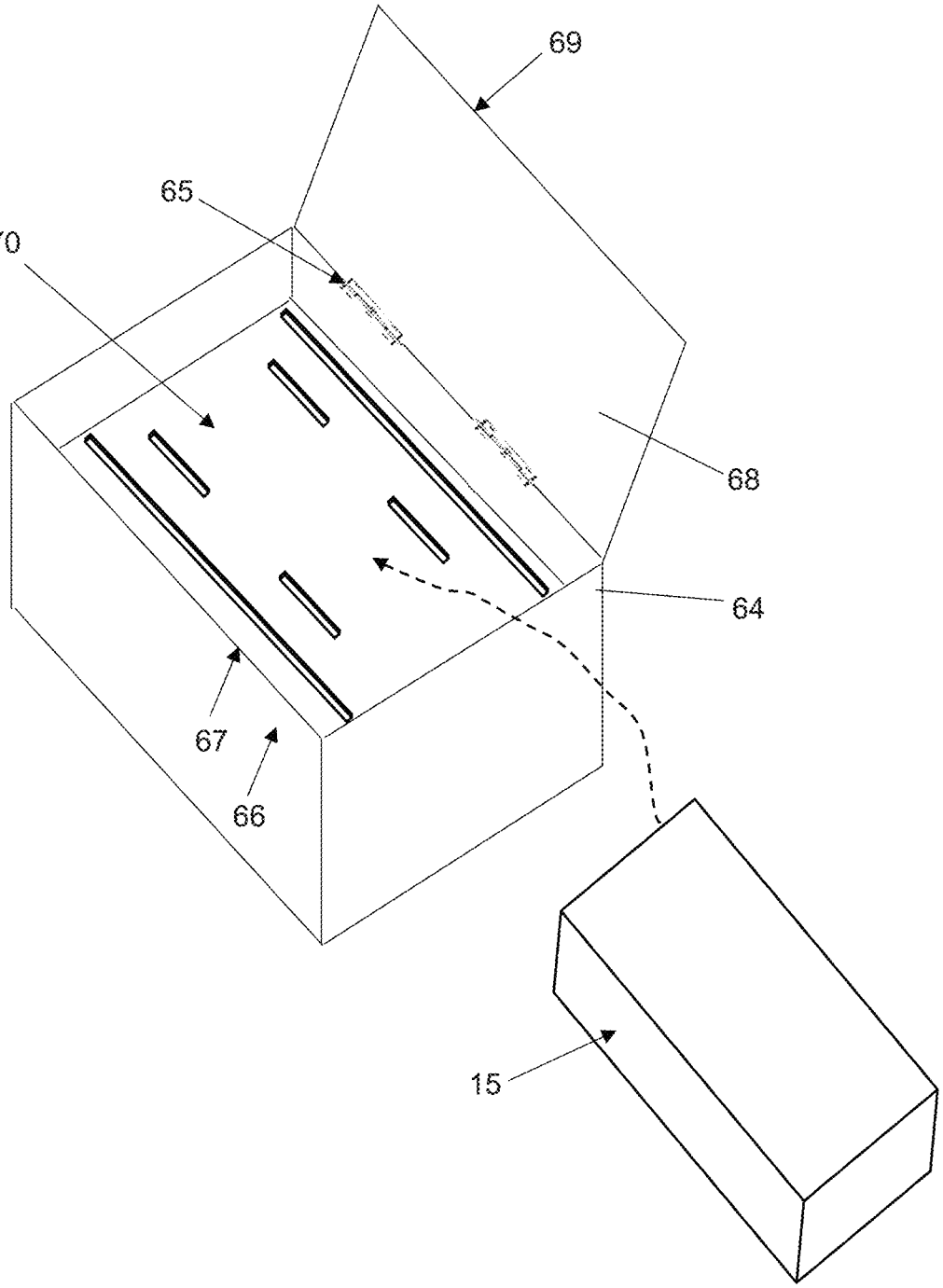
FIG. 7 is a perspective view of a portable power system component for a trolling motor in accordance with embodiments of the present disclosure.

The foregoing and other aspects of the present disclosure will now be described in more detail with respect to the description and methodologies provided herein. It should be appreciated that the disclosure can be embodied in different forms and should not be construed as limited to the embodiments set forth herein. Rather, these embodiments are provided so that this disclosure will be thorough and complete, and will fully convey the scope of the disclosure to those skilled in the art.

The terminology used in the description of the disclosure herein is for the purpose of describing particular embodiments only and is not intended to be limiting of the disclosure. As used in the description of the embodiments of the disclosure and the appended claims, the singular forms "a", "an" and "the" are intended to include the plural forms as well, unless the context clearly indicates otherwise. For example, a bolt can include one, two or more bolts, a rod holder can include one, two or more rod holders, etc. Also, as used herein, "and/or" refers to and encompasses any and all possible combinations of one or more of the associated listed items.

As used herein, the terms "comprise," "comprises," "comprising," "include," "includes" and "including" specify the presence of stated features, steps, operations, elements, and/or components, but do not preclude the presence or addition of one or more other features, steps, operations, elements, components, and/or groups thereof.

As shown in FIGS. 1 through 7, the present disclosure relates to a trolling motor 10 including a power source 12 that employs one or more rechargeable batteries 15 in rendering the trolling motor 10 and the power source 12 to be an integrated system. The battery or batteries 15 can be lithium ion, according to various embodiments of the present disclosure. The batteries 15 can be of different voltages based on the power need of the trolling motor. For example, the voltage can be 12V, 24V, 36V or another voltage. As shown in FIGS. 1 through 5, 9 and 10, the trolling motor 10 can include a head 19 with a housing or cover 20, a shaft 21, a drive unit 23, skeg 25, propellor 26, handle 27 and electronics with controls (not shown). The drive unit 23, skeg 25 and propellor 26 can be considered the lower unit of the trolling motor 10. The handle 27 permits the user to control the power and direction of the propellor 26 to affect the direction and speed of a water vessel to which the trolling motor 10 is attached. In various embodiments, a wireless remote is used to steer the trolling motor and no handle 27 is required. In some embodiments, the shaft 21 may be formed as an upper shaft joined with a lower shaft.

In various embodiments, the power source 12 is mounted in the housing 20 of the head 19 of the trolling motor 10, wherein the housing 20 is provided with a wall 28 and a hinged access door 22. It will be appreciated that the housing 20 including the wall 28 and door 22 can be provided in waterproof material to facilitate safe and effective operation in marine environments. The hinge 24 can extend along the entire door 22 or a portion thereof. The housing 20 can house a power pack docking station for the removable battery 15. According to various embodiments, there are multiple options for recharging the battery or batteries 15. For example, the batteries can be charged on land using a 110 V AC to 12V charging unit. Alternatively, an onboard charging station can be provided capable of charging the propulsion power source on the water vessel itself. Electrical wiring 39 connects the battery 15 with the drive unit 23 to provide power for operating the propellor 26.

In various embodiments such as shown in FIGS. 1 through 6, the mount 30 includes a removable flat trolling motor mounting base 32 attached to one or more tubes 34 that can be placed in a traditional rod holder 52 of a water vessel 50. The mounting base 32 can be secured to the trolling motor shaft 21 using a bracket or other trolling motor shaft securing device, for example. As shown in FIGS. 1 through 5, for example, the mount 30 can include one main tube 34 in a standard size to fit a traditional rod holder 52 with a substantially flat upper surface 33. The mounting base 32 and the tube(s) 34 can be formed as a monolithic, integrated unit in various embodiments. In alternative embodiments, the tube 34 is secured to the mounting base 32. The tube 34 extends from a substantially flat lower surface 79 of the mounting base 32, and the lower surface 79 mates with the deck of a vessel 50 when the mount 30 is installed.

In various embodiments, a marine vessel securing device operates to secure the mounting base 32 to the deck of a marine vessel. For example, the marine vessel securing device can include one or more stabilizing bolts 35 that extend through the mounting base and attach to the boat bow deck 51 or gunwale via a receiving element 55, such as a threaded head stainless steel button bolt receiver, for example. The receiver can be permanently mounted on the bow deck 51 and the stabilizing bolt(s) 35, which may be stainless steel T-bolts, for example, can be inserted into the threaded bow deck button bolt receiving element 55 to secure and stabilize the mount 30. As shown in dashed lines in FIG. 4, the bolts 35 are inserted into the receiving elements 55 and the tube 34 is inserted into the rod holder 52. In certain embodiments, multiple tubes 34 can be secured to the mounting base 32 and inserted into multiple rod holders 52. In embodiments where a rod holder is not available on the vessel 50, the mount 30 can be provided without a tube 34 and one or more bolts and receiving elements can be employed as described. The bolt mounting system of the present disclosure permits the removal of the trolling motor 10 and portable base 32 without the use of tools for security and/or when a trolling motor is not needed.

Figure 8:
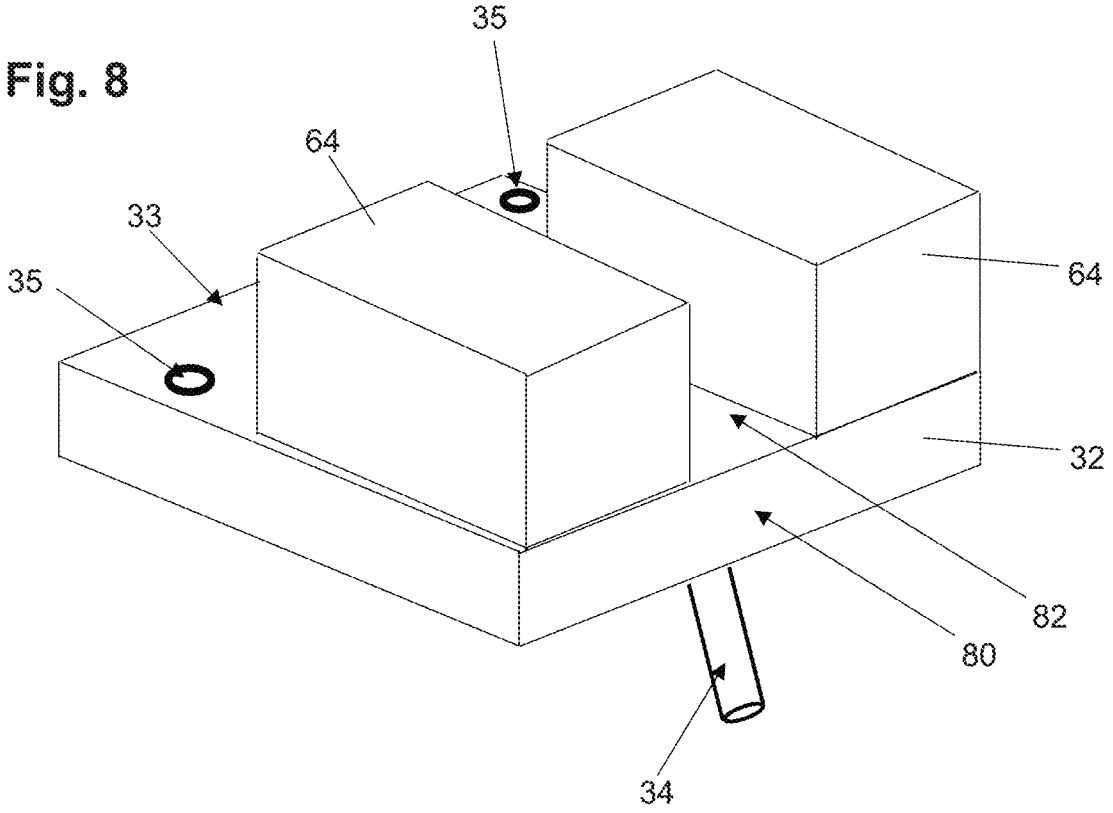
FIG. 8 is a perspective view of a portable power system component integrated with a mount for a trolling motor in accordance with embodiments of the present disclosure.
Figure 9:
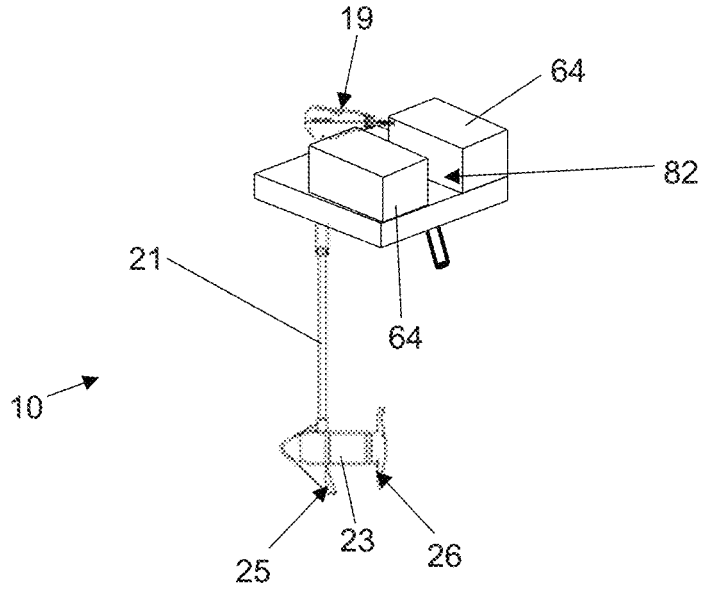
FIGS. 9 and 10 are perspective views of a portable power system component integrated with a mount and showing a trolling motor in accordance with embodiments of the present disclosure.
Figure 10:
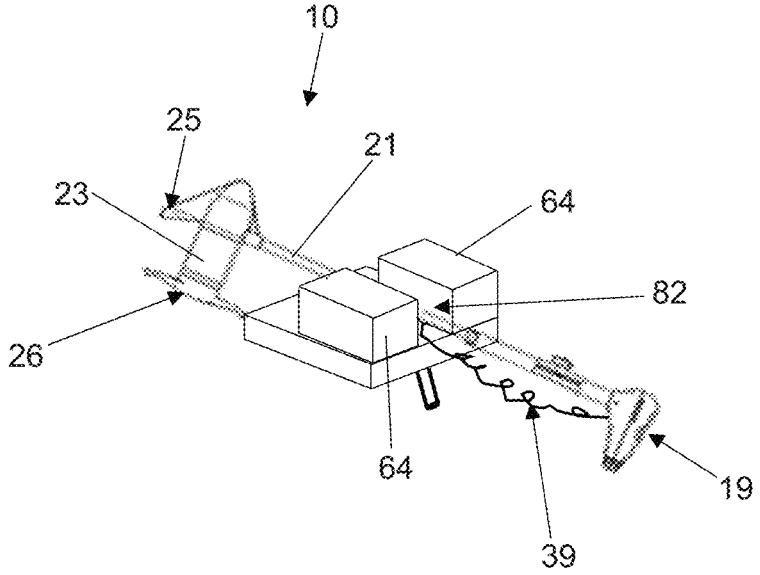

In the embodiments as shown in FIGS. 3 through 10, the trolling motor 10 can include a head 19, a shaft 21, a drive unit 23, skeg 25, propellor 26 and electronics with controls (not shown), as described above. In these embodiments, however, the power source such as battery 15 is mounted in a battery box or battery housing 64 provided in the mounting base 32. The housing 64 can include a housing wall 66 and an access door 68 which may open and close via one or more hinges 65. It will be appreciated that the battery housing 64 including the wall 66 and door 68 can be provided in waterproof material and the edges (e.g., 67, 69) can be provided with a seal such as a rubber material to facilitate safe, effective and waterproof operation in marine environments. The hinge(s) 65 can extend along the entire door 68 or a portion thereof. The housing 64 can house one or more power pack docking stations 70, each of which can removably engage a removable battery 15. The battery housing 64 assists in maintaining the battery 15 in position when installed. When engaged, the properly charged battery 15 provides a power source for the trolling motor 10. In FIGS. 8 through 10, two battery housings 64 are shown on the top surface 33 of the mounting base 32. Such housings 64 can be positioned on a front edge 80 of the mounting base 32 thereby adding weight for stabilization toward the interior of the marine vessel when installed. As shown in FIGS. 9 and 10, the trolling motor 10 can be positioned such that the shaft 21 lies in a slot 82 created by the positioning of the battery housings 64. When stored as such, as indicated in FIG. 10, the propellor 26 is out of the water surrounding the vessel. When in use, as indicated by the positioning in FIG. 9, the head 19 of the trolling motor 10 can lie on or above the top flat surface 33 of the mounting base 32 and the propellor 26 is then in the water body for use in propelling and steering the vessel. The size of the housing(s) 64 for the one or more batteries 15 can be provided based on the voltage requirements of the trolling motor being used.

It will be appreciated that the presently disclosed system and device can operate with one battery, or two or more batteries depending upon the voltage requirements of a particular application. According to various embodiments, there are multiple options for recharging the battery or batteries 15. The batteries can be charged on land using a 110 V AC to 12V charging unit. Alternatively, an onboard charging station can be provided capable of charging the propulsion power source on the water vessel itself. Electrical wiring 39 connects the battery 15 with the drive unit 23 of the trolling motor 10 to provide power for operating the propellor 26. It will be appreciated that the wiring 39 includes appropriate electrical leads to permit simple connection to the power source maintained within the battery housing(s) 64 on the mounting base 32. For example, the leads can be connected to suitable connectors on the one or more docking stations 70.

As further shown in FIGS. 6 and 8 through 10, the mounting base 32 can be formed with or secured to a tube 34 extending from the lower surface 79 of the mounting base. When formed together, the tube 34 and mounting base are a monolithic, integrated unit. In alternative embodiments, the tube 34 is secured to the mounting base 32 such as by using an epoxy material. The battery housing(s) 64 can also be secured to the mounting base 32 using an epoxy material. It will be appreciated that more than one tube 34 can be employed to facilitate securing the mounting base 32 to a marine vessel when more than one opening such as a fishing rod holder is available. Particularly as the size of the marine vessel and mounting base 32 of the present disclosure may be used to accommodate the needs of larger vessels, the tube(s) 34 facilitate stable connections and securing of the mounting base 32 and hence the trolling motor 10 to the vessel. In various embodiments, the trolling motor 10 and/or mounting base 32 can be removed when it is desired to move the marine vessel at higher speeds. Such removal may reduce the risk of damage or trauma to the device and/or the vessel, as the bow of the vessel will rise and fall more substantially than the stern when the vessel is operated at higher speeds and/or in rougher water environments.

It will be appreciated that the combination of the power source and portable mounting system as disclosed herein greatly improve the existing mounting and location options for trolling motor users.

Although the present approach has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present approach.

The invention claimed is:

1. A propulsion system, comprising:

a motor comprising a drive unit and a shaft;

a power source in communication with the motor for providing power to the motor;

a housing for the power source, wherein the housing comprises a plurality of housings separated by a slot, wherein each of the plurality of housings comprises a housing wall and a housing door, wherein the housing door is movably secured to the housing wall;

a mount secured to the motor, wherein the mount comprises a mounting base and at least one tube, wherein the tube is removably securable to an existing opening on a marine vessel; and wherein the shaft is positionable within the slot and removable from the slot.

2. The propulsion system of claim 1, wherein the housing is comprised of waterproof material.

3. The propulsion system of claim 1, wherein the mounting base and the at least one tube comprise a monolithic, integrated unit.

4. The propulsion system of claim 1, wherein each of the plurality of housings has an interior compartment that houses a docking station for a removable battery.

5. The propulsion system of claim 4, wherein the removable battery is rechargeable.

6. The propulsion system of claim 4, wherein the removable battery is rechargeable onboard the marine vessel.

7. The propulsion system of claim 1, wherein the motor is secured to the mounting base.

8. The propulsion system of claim 1, wherein the mount further comprises at least one bolt removably securable to the marine vessel.

9. The propulsion system of claim 1, wherein the mounting base is secured to the shaft.

10. A device for mounting a propulsion unit to a marine vessel, comprising:

a mounting base;

a plurality of housings secured to the mounting base, wherein the plurality of housings are separated by a slot adapted to receive a shaft of a propulsion unit;

a tube extending from the mounting base for insertion through an opening on a marine vessel;

a threaded bolt extending through the mounting base; and a button bolt receiver, wherein the button bolt receiver can be secured to a marine vessel and the threaded bolt can by threadedly secured to the button bolt receiver.

11. The device of claim 10, wherein the base is substantially flat.

12. The device of claim 10, wherein the threaded bolt comprises a pair of threaded bolts extending through the base, and wherein the button bolt receiver comprises a pair of button bolt receivers.

13. The device of claim 10, wherein the base and the tube comprise a monolithic, integrated unit.

14. The device of claim 10, wherein the tube is secured to the mounting base.

15. A device for mounting a propulsion unit to a marine vessel, comprising:

a mounting base, comprising a lower surface and a housing, wherein the housing comprises a plurality of housings separated by a slot;

a marine vessel securing device extending from the lower surface of the mounting base;

a trolling motor shaft securing device secured to or formed in the mounting base; and a power source stored within the housing for providing power to a trolling motor secured to a trolling motor shaft attached to the trolling motor shaft securing device, wherein the trolling motor shaft can be positioned in the slot.

16. The device of claim 15, wherein each of the plurality of housings comprises a housing wall and a housing door, wherein the housing door is movably secured to the housing wall.

17. The device of claim 15, further comprising a button bolt receiver, wherein the button bolt receiver can be secured to the marine vessel and the marine vessel securing device can by threadedly secured to the button bolt receiver.

18. The device of claim 15, wherein the marine vessel securing device comprises a threaded bolt.

19. The device of claim 15, wherein the marine vessel securing device comprises a tube secured to the base for insertion through an opening on the marine vessel.

* * * * *